US012089655B2

(12) United States Patent
Kim et al.

(10) Patent No.: US 12,089,655 B2
(45) Date of Patent: Sep. 17, 2024

(54) AEROSOL GENERATING APPARATUS AND A METHOD FOR CONTROLLING THE SAME

(71) Applicant: KT&G CORPORATION, Daejeon (KR)

(72) Inventors: Yong Hwan Kim, Gyeonggi-do (KR); Sung Wook Yoon, Gyeonggi-do (KR); Seung Won Lee, Gyeonggi-do (KR); Dae Nam Han, Seoul (KR)

(73) Assignee: KT&G CORPORATION, Daejeon (KR)

( * ) Notice: Subject to any disclaimer, the term of this patent is extended or adjusted under 35 U.S.C. 154(b) by 0 days.

(21) Appl. No.: 17/286,766

(22) PCT Filed: Dec. 22, 2020

(86) PCT No.: PCT/KR2020/018874
§ 371 (c)(1),
(2) Date: Sep. 16, 2021

(87) PCT Pub. No.: WO2021/182730
PCT Pub. Date: Sep. 16, 2021

(65) Prior Publication Data

US 2024/0041128 A1 Feb. 8, 2024

(30) Foreign Application Priority Data

Mar. 9, 2020 (KR) ..... 10-2020-0029169

(51) Int. Cl.
*A24F 40/53* (2020.01)
*A24F 40/60* (2020.01)

(52) U.S. Cl.
CPC ..... *A24F 40/53* (2020.01); *A24F 40/60* (2020.01)

(58) Field of Classification Search
CPC ..... A24F 40/30; A24F 40/20; A24F 40/10; A24F 40/60; A24F 40/53
See application file for complete search history.

(56) References Cited

U.S. PATENT DOCUMENTS 11,147,316 B2 10/2021 Farine et al.
2017/0027234 A1 2/2017 Farine et al.
(Continued)

FOREIGN PATENT DOCUMENTS

CN 202912579 U 5/2013
CN 104460644 A 3/2015
(Continued)

OTHER PUBLICATIONS

Written opinion for PCT/KR2020/018874 dated Apr. 5, 2021.
(Continued)

*Primary Examiner* — Jean F Duverne
(74) *Attorney, Agent, or Firm* — Sughrue Mion, PLLC

(57) ABSTRACT

An aerosol generating apparatus according to an aspect includes a memory that stores data relating to a state of the aerosol generating apparatus, a display that outputs information relating to the aerosol generating apparatus, and a processor, and the processor detects an abnormal operation of the aerosol generating apparatus based on data stored in the memory, performs self-diagnosis on modules included in the aerosol generating apparatus as the abnormal operation is detected, and controls the display to output a first solution corresponding to an error detected according to the self-diagnosis.

12 Claims, 16 Drawing Sheets

(56) References Cited

U.S. PATENT DOCUMENTS

| | | | | |
|---|---|---|---|---|
| 2018/0043114 | A1 | 2/2018 | Bowen et al. | |
| 2019/0171773 | A1 | 6/2019 | Wang | |
| 2019/0387795 | A1* | 12/2019 | Fisher | H05B 1/0244 |
| 2020/0000146 | A1* | 1/2020 | Anderson | H01R 13/6205 |
| 2020/0250629 | A1 | 8/2020 | Fernando et al. | |
| 2020/0281276 | A1 | 9/2020 | Akao et al. | |

FOREIGN PATENT DOCUMENTS

| | | | | |
|---|---|---|---|---|
| CN | 106231934 | A | 12/2016 | |
| CN | 107332722 | A | 11/2017 | |
| CN | 109115264 | A | 1/2019 | |
| CN | 109344983 | A | 2/2019 | |
| CN | 110162423 | A | 8/2019 | |
| CN | 110224892 | A | 9/2019 | |
| KR | 10-2016-0147256 | A | 12/2016 | |
| KR | 10-2017-0140189 | A | 12/2017 | |
| KR | 10-2019-0011264 | A | 2/2019 | |
| WO | 2018-203044 | A1 | 11/2018 | |
| WO | 2019-011623 | A1 | 1/2019 | |
| WO | 2019-049028 | A1 | 3/2019 | |
| WO | 2019/077709 | A1 | 4/2019 | |
| WO | WO-2019146061 | A1 * | 8/2019 | A24F 40/42 |
| WO | WO-2019146062 | A1 * | 8/2019 | A24D 1/20 |
| WO | WO-2019146063 | A1 * | 8/2019 | A24D 1/20 |
| WO | 2019/220348 | A1 | 11/2019 | |

OTHER PUBLICATIONS

International search report for PCT/KR2020/018874 dated Apr. 5, 2021.

Extended European Search Report issued Nov. 25, 2021 in European Application No. 20873379.0.

Chinese Office Action dated May 11, 2023 in Chinese Application No. 202080039451.X.

* cited by examiner

FIG. 7

700

19.08.07 14:21:32 Heating Start
710 19.08.07 14:21:33 -Er: Device Hot
19.08.07 14:22:12 Ready
19.08.07 14:25:42 User Off
19.08.07 14:25:49 Sleep
19.08.07 14:58:33 Wake Up
19.08.07 14:58:38 Heating Start
19.08.07 14:59:18 Ready
710 19.08.07 15:03:14 -Er: Heater Overheat
19.08.07 15:03:48 Smoke Finish
710 19.08.07 15:46:11 -Er: Quiescent Current
19.08.07 17:08:11 Heating Start
710 19.08.07 17:08:12 -Er: Device Hot
19.08.07 17:21:35 Charging Start
19.08.07 17:21:42 Sleep
19.08.07 18:40:02 Charging Finish
19.08.07 19:57:19 Wake Up
19.08.07 19:59:11 Sleep
19.08.07 21:20:03 Wake Up
19.08.07 21:20:06 Heating Start
710 19.08.07 21:20:41 -Er: Heater Overcurrent
19.08.07 21:20:46 Ready
19.08.07 21:25:16 Smoke Finish
19.08.07 21:25:21 Heating Start
19.08.07 21:26:01 Ready
19.08.07 21:30:31 Smoke Finish
19.08.07 21:30:37 Heating Start
710 19.08.07 21:30:38 -Er: Device Hot

AEROSOL GENERATING APPARATUS AND A METHOD FOR CONTROLLING THE SAME

TECHNICAL FIELD

The present disclosure relates to an aerosol generating apparatus and a method of controlling the aerosol generating apparatus.

BACKGROUND ART

In recent years, there has been growing demand for an aerosol generating apparatus that overcome many disadvantages of traditional combustive cigarettes. As a result, there is increasing demand for a method of solving an error generated in an aerosol generating apparatus.

DISCLOSURE

Technical Problem

The present disclosure provides an aerosol generating apparatus and a method of controlling the aerosol generating apparatus. Specifically, the present disclosure provides a method of detecting an error generated in an aerosol generating apparatus and providing a solution for solving the detected error. Meanwhile, technical problems to be solved by the present disclosure are not limited to the technical problems described above, and other technical problems may be inferred from the following embodiments.

Technical Solution

An aerosol generating apparatus according to an aspect includes a memory that stores data relating to a state of the aerosol generating apparatus; a display that outputs information relating to the aerosol generating apparatus; and a processor, and the processor detects an abnormal operation of the aerosol generating apparatus based on data stored in the memory, performs self-diagnosis on modules included in the aerosol generating apparatus as the abnormal operation is detected, and controls the display to output a first solution corresponding to an error detected according to the self-diagnosis.

An aerosol generating apparatus according to another aspect includes a display that outputs information relating to the aerosol generating apparatus; and a processor, and the processor controls the display to output a first solution and a second solution corresponding to an error generated in the aerosol generating apparatus at different points of time.

A method of controlling an aerosol generating apparatus according to another aspect includes detecting an abnormal operation of the aerosol generating apparatus based on data stored in a memory; performing self-diagnosis on modules included in the aerosol generating apparatus when the abnormal operation is detected; and controlling a display to output a first solution corresponding to an error detected according to the self-diagnosis.

A computer-readable recording medium according to another aspect includes a recording medium on which is recorded a program for performing the method described above on a computer.

Advantageous Effects

An aerosol generating apparatus may detect an error by performing self-diagnosis without depending solely on log data. Accordingly, an error generated in an aerosol generating apparatus may be accurately detected. In addition, an aerosol generating apparatus may provide different solutions sequentially according to whether or not an error is resolved. Accordingly, a user may quickly and efficiently repair an aerosol generating apparatus, thereby saving time and cost.

DESCRIPTION OF DRAWINGS

FIG. 7 is a diagram illustrating an example of log data generated by an aerosol generating apparatus;

BEST MODE

Hereinafter, the present disclosure will now be described more fully with reference to the accompanying drawings, in which exemplary embodiments of the present disclosure are shown such that one of ordinary skill in the art may easily work the present disclosure. The disclosure may, however, be embodied in many different forms and should not be construed as being limited to the embodiments set forth herein.

With respect to the terms used to describe the various embodiments, general terms which are currently and widely used are selected in consideration of functions of structural elements in the various embodiments of the present disclosure. However, meanings of the terms can be changed according to intention, a judicial precedence, the appearance of new technology, and the like. In addition, in certain cases, a term which is not commonly used can be selected. In such a case, the meaning of the term will be described in detail at the corresponding portion in the description of the present disclosure. Therefore, the terms used in the various embodiments of the present disclosure should be defined based on the meanings of the terms and the descriptions provided herein.

In addition, unless explicitly described to the contrary, the word "comprise" and variations such as "comprises" or "comprising" will be understood to imply the inclusion of stated elements but not the exclusion of any other elements.

Hereinafter, the present disclosure will now be described more fully with reference to the accompanying drawings, in which exemplary embodiments of the present disclosure are shown such that one of ordinary skill in the art may easily work the present disclosure. The disclosure may, however, be embodied in many different forms and should not be construed as being limited to the embodiments set forth herein.

In addition, the terms including ordinal numbers such as 'first' or 'second' used in the present specification can be used to describe various elements, but they should not be limited thereto. The terms are used only for the purpose of distinguishing one elements from another.

Hereinafter, embodiments will be described in detail with reference to the drawings.

Figure 1:
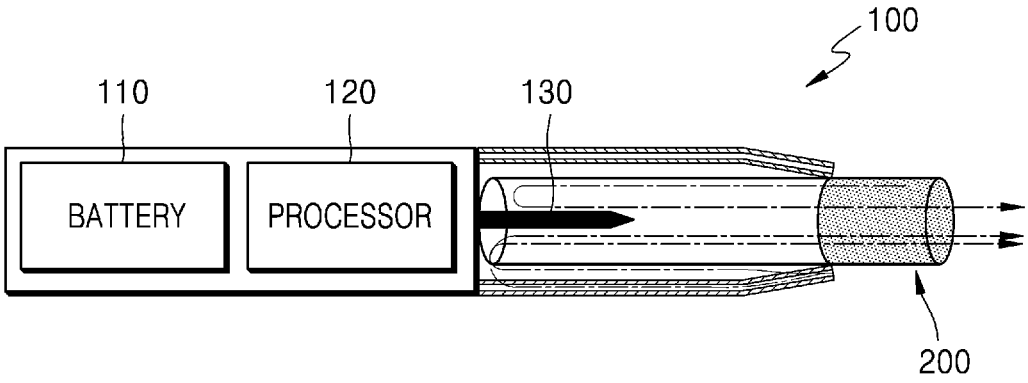
FIG. 1 is a diagram illustrating an example of an aerosol generating apparatus.

FIG. 1 shows a view showing an example of the aerosol generating article.

Referring to FIG. 1, the aerosol generating apparatus 100 may include a battery 110, a processor 120, and a heater 130. Also, the aerosol generating article 200 may be inserted into an inner space of the aerosol generating apparatus 100.

FIG. 1 illustrates components of the aerosol generating apparatus 100, which are related to the present embodiment. Therefore, it will be understood by one of ordinary skill in the art related to the present embodiment that other general-purpose components may be further included in the aerosol generating apparatus 100, in addition to the components illustrated in FIG. 1.

FIG. 1 illustrates that the battery 110, the processor 120, and the heater 130 are arranged in series. However, the internal structure of the aerosol generating apparatus 100 is not limited to the structures illustrated in FIG. 1. In other words, according to the design of the aerosol generating apparatus 100, the battery 110, the processor 120, and the heater 130 may be differently arranged.

When the aerosol generating article 200 is inserted into the aerosol generating apparatus 100, the aerosol generating apparatus 100 may operate the heater 130 to generate aerosol. The aerosol generated by the heater 130 is delivered to a user by passing through the aerosol generating article 200.

As necessary, even when the aerosol generating article 200 is not inserted into the aerosol generating apparatus 100, the aerosol generating apparatus 100 may heat the heater 130.

The battery 110 supplies power to be used for the aerosol generating apparatus 100 to operate. The battery 110 supplies power to be used for the aerosol generating apparatus 100 to operate. Also, the battery 110 may supply power for operations of a display, a sensor, a motor, etc. mounted in the aerosol generating apparatus 100.

The processor 120 may generally control operations of the aerosol generating apparatus 100. In detail, the processor 120 may control not only operations of the battery 110, the heater 130, and the vaporizer 140, but also operations of other components included in the aerosol generating apparatus 100. Also, the processor 120 may check a state of each of the components of the aerosol generating apparatus 100 to determine whether or not the aerosol generating apparatus 100 is able to operate.

A processor 120 can be implemented as an array of a plurality of logic gates or can be implemented as a combination of a general-purpose microprocessor and a memory in which a program executable in the microprocessor is stored. It will be understood by one of ordinary skill in the art that the processor can be implemented in other forms of hardware.

The heater 130 may be heated by the power supplied from the battery 110. For example, when the aerosol generating article 200 is inserted into the aerosol generating apparatus 100, the heater 130 may be located outside the aerosol generating article 200. Thus, the heated heater 130 may increase a temperature of an aerosol generating material in the aerosol generating article 200.

The heater 130 may include an electro-resistive heater. For example, the heater 130 may include an electrically conductive track, and the heater 130 may be heated when currents flow through the electrically conductive track. However, the heater 130 is not limited to the example described above and may include any other heaters which may be heated to a desired temperature. Here, the desired temperature may be pre-set in the aerosol generating apparatus 100 or may be set by a user.

For example, the heater 130 may be elongate (e.g., rod-shaped, needle-shaped, blade-shaped) or cylindrical, and may heat the inside or outside of the aerosol generating article 200 according to the shape of the heating element.

Also, the aerosol generating apparatus 100 may include a plurality of heaters 130. Here, the plurality of heaters 130 may be inserted into the aerosol generating article 200 or may be arranged outside the aerosol generating article 200. Also, some of the plurality of heaters 130 may be inserted into the aerosol generating article 200 and the others may be arranged outside the aerosol generating article 200. In addition, the shape of the heater 130 is not limited to the shape illustrated in FIG. 1, and may include various shapes.

The aerosol generating apparatus 100 may further include general-purpose components in addition to the battery 110, the processor 120, and the heater. For example, the aerosol generating apparatus 100 may include a display capable of outputting visual information and/or a motor for outputting haptic information. Also, the aerosol generating apparatus 100 may include at least one sensor (e.g., a puff detecting sensor, a temperature detecting sensor, an aerosol generating article insertion detecting sensor, etc.). Also, the aerosol generating apparatus 100 may be formed as a structure that, even when the aerosol generating article 200 is inserted into the aerosol generating apparatus 100, may introduce external air or discharge internal air.

Although not illustrated in FIG. 1, the aerosol generating apparatus 100 and an additional cradle may form together a system. For example, the cradle may be used to charge the battery 110 of the aerosol generating apparatus 100. Alternatively, the heater 130 may be heated when the cradle and the aerosol generating apparatus 100 are coupled to each other.

The aerosol generating article 200 may be similar to a general cigarette. For example, the aerosol generating article 200 may be divided into a first portion including an aerosol generating material and a second portion including a filter, etc. Alternatively, the second portion of the aerosol generating article 200 may also include an aerosol generating material. For example, an aerosol generating material made in the form of granules or capsules may be inserted into the second portion.

The first portion may be completely inserted into the aerosol generating apparatus 100, and the second portion may be exposed to the outside. Alternatively, only a portion of the first portion may be inserted into the aerosol generating apparatus 100, or the entire first portion and a portion of the second portion may be inserted into the aerosol generating apparatus 100. The user may puff aerosol while holding the second portion by the mouth of the user. In this case, the aerosol is generated by the external air passing through the first portion, and the generated aerosol passes through the second portion and is delivered to the user's mouth.

For example, the external air may flow into at least one air passage formed in the aerosol generating apparatus 100. For example, opening and closing of the air passage and/or a size of the air passage formed in the aerosol generating apparatus 100 may be adjusted by the user. Accordingly, the amount of smoke and a smoking impression may be adjusted by the user. As another example, the external air may flow into the aerosol generating article 200 through at least one hole formed in a surface of the aerosol generating article 200.

Figure 2:
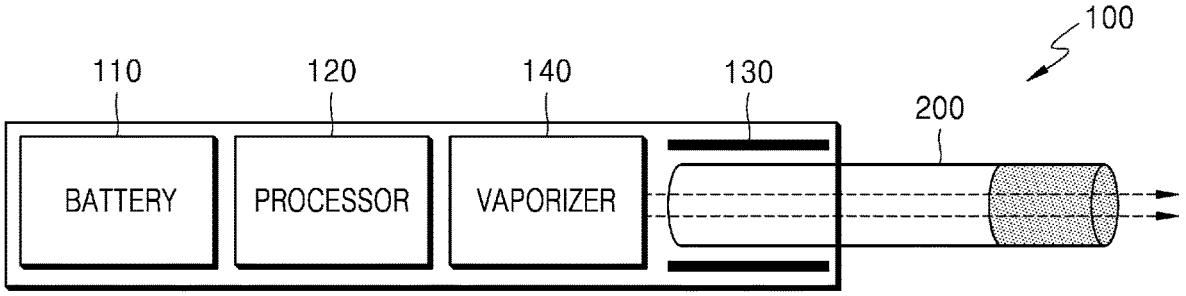
FIG. 2 is a diagram illustrating another example of an aerosol generating apparatus.

FIG. 2 shows a view showing another example of the aerosol generating article.

Referring to FIG. 2, the aerosol generating apparatus 100 may further include a vaporizer 140 in addition to the components illustrated in FIG. 1. The aerosol generating article 200, the battery 110, the processor 120, and the heater 130 of FIG. 2 may correspond to those of FIG. 1. Therefore, redundant descriptions are omitted.

FIG. 2 illustrates components of the aerosol generating apparatus 100, which are related to the present embodiment. Therefore, it will be understood by one of ordinary skill in the art related to the present embodiment that other general-purpose components may be further included in the aerosol generating apparatus 100, in addition to the components illustrated in FIG. 2.

Also, FIG. 2 illustrates that the aerosol generating apparatus 100 includes the heater 130. However, as necessary, the heater 130 may be omitted.

Also, FIG. 2 illustrates that the battery 110, the processor 120, the vaporizer 140, and the heater 130 are arranged in series.

When the aerosol generating article 200 is inserted into the aerosol generating apparatus 100, the aerosol generating apparatus 100 may operate the heater 130 and/or the vaporizer 140 to generate aerosol. The aerosol generated by the heater 130 and/or the vaporizer 140 is delivered to a user by passing through the aerosol generating article 200.

The battery 110 may supply power such that the vaporizer 140 may be heated. The processor 120 controls operations of the vaporizer 140.

The vaporizer 140 may generate aerosol by heating a liquid composition and the generated aerosol may pass through the aerosol generating article 200 to be delivered to a user. In other words, the aerosol generated via the vaporizer 140 may move along an air flow passage of the aerosol generating apparatus 100 and the air flow passage may be configured such that the aerosol generated via the vaporizer 140 passes through the aerosol generating article 200 to be delivered to the user.

For example, the vaporizer 140 may include a liquid storage, a liquid delivery element, and a heating element, but it is not limited thereto. For example, the liquid storage, the liquid delivery element, and the heating element may be included in the aerosol generating apparatus 100 as independent modules.

The liquid storage may store a liquid composition. For example, the liquid composition may be a liquid including a tobacco-containing material having a volatile tobacco flavor component, or a liquid including a non-tobacco material. The liquid storage may be formed to be detachable from the vaporizer 140 or may be formed integrally with the vaporizer 140.

For example, the liquid composition may include water, a solvent, ethanol, plant extract, spices, flavorings, or a vitamin mixture. The spices may include menthol, peppermint, spearmint oil, and various fruit-flavored ingredients, but are not limited thereto. The flavorings may include ingredients capable of providing various flavors or tastes to a user. Vitamin mixtures may be a mixture of at least one of vitamin A, vitamin B, vitamin C, and vitamin E, but are not limited thereto. Also, the liquid composition may include an aerosol forming substance, such as glycerin and propylene glycol.

The liquid delivery element may deliver the liquid composition of the liquid storage to the heating element. For example, the liquid delivery element may be a wick such as cotton fiber, ceramic fiber, glass fiber, or porous ceramic, but is not limited thereto.

The heating element is an element for heating the liquid composition delivered by the liquid delivery element. For example, the heating element may be a metal heating wire, a metal hot plate, a ceramic heater, or the like, but is not limited thereto. In addition, the heating element may include a conductive filament such as nichrome wire and may be positioned as being wound around the liquid delivery element. The heating element may be heated by a current supply and may transfer heat to the liquid composition in contact with the heating element, thereby heating the liquid composition. As a result, aerosol may be generated.

For example, the vaporizer 140 may be referred to as a cartomizer or an atomizer, but it is not limited thereto.

Figure 3:
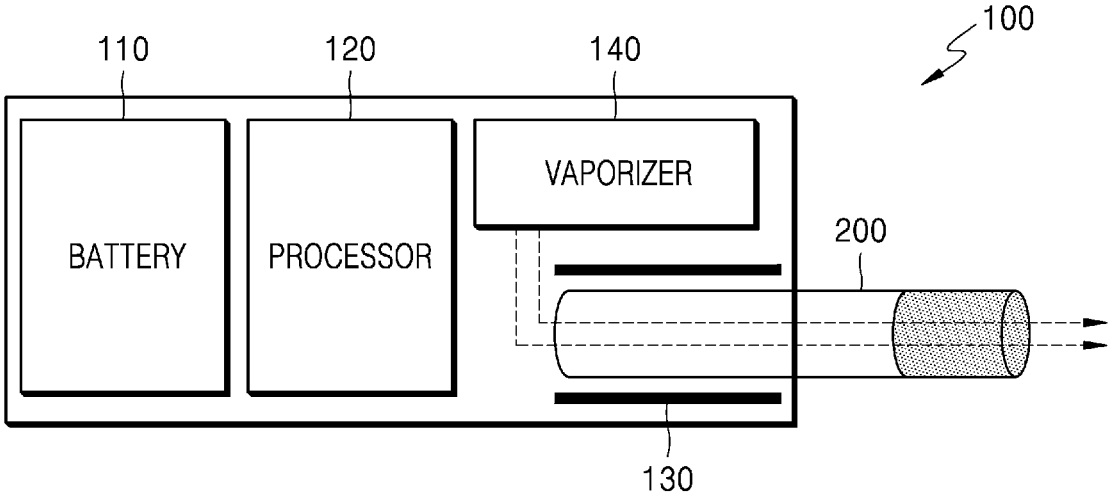
FIG. 3 is a diagram illustrating another example of an aerosol generating apparatus.

FIG. 3 shows a view showing another example of the aerosol generating apparatus.

The aerosol generating article 200, the battery 110, the processor 120, and the heater 130 of FIG. 3 may correspond to those of FIG. 2. Therefore, redundant descriptions are omitted.

FIG. 3 illustrates an example in which the vaporizer 140 and the heater 130 are arranged in parallel. In other words, the vaporizer 140 and the heater 130 may be arranged in series as shown in FIG. 2 or in parallel as shown in FIG. 3. However, the internal structure of the aerosol generating apparatus 100 is not limited to the structures illustrated in FIGS. 2 and 3. In other words, according to the design of the aerosol generating apparatus 100, the battery 110, the processor 120, the heater 130, and the vaporizer 140 may be differently arranged.

Figure 4:
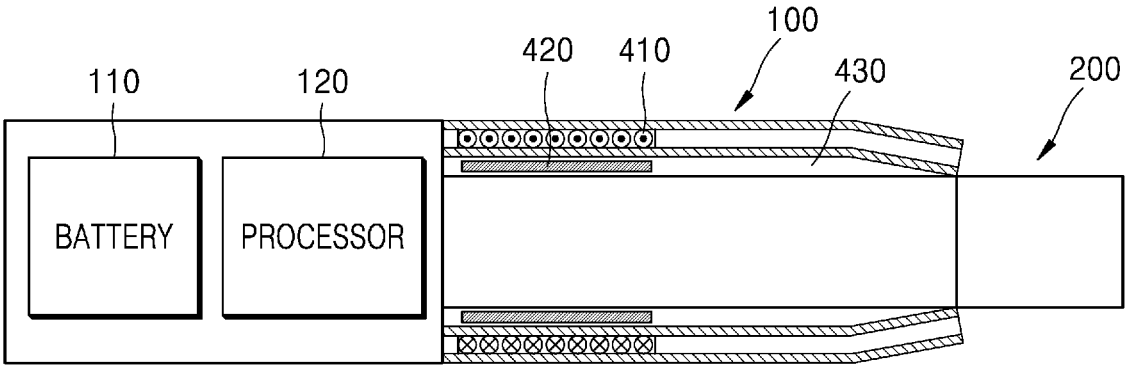
FIG. 4 is a diagram illustrating another example of an aerosol generating apparatus.

FIG. 4 shows a view showing another example of the aerosol generating apparatus.

Referring to FIG. 4, the aerosol generating apparatus 100 may include a battery 110, a processor 120, a coil 410, and a susceptor 420. In addition, at least a portion of the aerosol generating article 200 may be accommodated in the cavity 430 of the aerosol generating apparatus 100. The aerosol generating article 200, battery 110, and processor 120 of FIG. 4 may correspond to those of FIGS. 1 through 3. In addition, the coil 410 and the susceptor 420 may be included in the heater 130. Therefore, redundant descriptions are omitted.

The aerosol generating apparatus 100 shown in FIG. 4 illustrates the components related to the present embodiment. Therefore, it will be understood by one of ordinary skill in the art related to the present embodiment that other general-purpose components may be further included in the aerosol generating apparatus 100, in addition to the components illustrated in FIG. 4.

The coil 410 may be located around the cavity 430. FIG. 4 illustrates that the coil 410 is arranged to surround the cavity 430, but is not limited thereto.

When the aerosol generating article 200 is accommodated in the cavity 430 of the aerosol generating apparatus 100, the aerosol generating apparatus 100 may supply power to the coil 410 so that the coil 410 generates a magnetic field. As the magnetic field generated by the coil 410 passes through the susceptor 420, the susceptor 420 may be heated.

This induction heating phenomenon is a known phenomenon described as Faraday's Law of induction. In detail, when the magnetic induction in the susceptor 420 changes, an electric field is generated in the susceptor 420, so that an eddy current flows in the susceptor 420. Eddy current generates heat proportional to the current density and the conductor resistance within the susceptor 420.

As the susceptor 420 is heated by the eddy current, and the aerosol generating material in the aerosol generating article 200 is heated by the heated susceptor 420, aerosol may be generated. The aerosol generated from the aerosol generating material passes through the aerosol generating article 200 and is delivered to the user.

The battery 110 may supply power so that the coil 410 may generate a magnetic field. The processor 120 may be electrically connected to the coil 410.

The coil 410 may be an electrically conductive coil that generates a magnetic field by power supplied from the battery 110. The coil 410 may be arranged to surround at least a portion of the cavity 430. The magnetic field generated by the coil 410 may be applied to the susceptor 420 disposed at the inner end of the cavity 430.

The susceptor 420 is heated as the magnetic field generated from the coil 410 penetrates, and may include metal or carbon. For example, the susceptor 420 may include at least one of ferrite, ferromagnetic alloy, stainless steel, and aluminum.

In addition, the susceptor 420 may include at least one of ceramic (such as graphite, molybdenum, silicon carbide, niobium, nickel alloy, metal film, zirconia, or the like), transition metal (such as nickel (Ni) or cobalt (Co)), and metalloid (such as boron (B) or phosphorus (P)). However the susceptor 420 is not limited to the example described above and may include any other susceptors which may be heated to a desired temperature as a magnetic field is applied. Here, the desired temperature may be pre-set in the aerosol generating apparatus 100 or may be set by a user.

When the aerosol generating article 200 is accommodated in the cavity 430 of the aerosol generating apparatus 100, the susceptor 420 may be arranged to surround at least a portion of the aerosol generating article 200. Thus, the heated susceptor 420 may increase a temperature of an aerosol generating material in the aerosol generating article 200.

FIG. 4 illustrates that the susceptor 420 is arranged to surround at least a portion of the aerosol generating article, but is not limited thereto. For example, the susceptor 420 may include a tube-type heating element, a plate-type heating element, a needle-type heating element, or a rod-type heating element, and may heat the inside or the outside of the aerosol generating article 200, according to the shape of the heating element.

Also, the aerosol generating apparatus 100 may include a plurality of susceptors 420. In this case, the plurality of susceptors 420 may be located outside or inserted into the aerosol generating article 200. Also, some of the plurality of susceptors 420 may be inserted into the aerosol generating article 200 and the others may be arranged outside the aerosol generating article 200. In addition, the shape of the susceptor 420 is not limited to the shape illustrated in FIG. 4, and may include various shapes.

When an abnormal operation of any one of a plurality of modules included in the aerosol generating apparatus 100 is detected, the aerosol generating apparatus 100 may not operate normally. In this case, the abnormal operation of the aerosol generating apparatus 100 may be resolved by a simple action taken by a user depending on a cause of the abnormal operation. However, when the aerosol generating apparatus 100 does not operate normally, a user generally visits a repair shop or purchases a new apparatus. Accordingly, there is a problem in that costs unnecessary for a user are generated.

In addition, when an abnormal operation of the aerosol generating apparatus 100 is detected, an appropriate solution may be suggested only when a cause of the abnormal operation is accurately identified. However, general aerosol generating apparatuses do not self-identify the cause of abnormal operation, and thus, an appropriate solution may not be provided to a user.

When identifying an abnormal operation, the aerosol generating apparatus 100 according to the present disclosure performs a self-diagnosis on modules included in the aerosol generating apparatus 100. In addition, the aerosol generating apparatus 100 detects an accurate error according to the self-diagnosis and outputs a solution corresponding to the detected error.

In particular, the aerosol generating apparatus 100 may present a plurality of solutions depending on errors. For example, the aerosol generating apparatus 100 outputs a first solution that a user may perform and determines whether or not the error is resolved according to the first solution. If the error is not resolved according to the first solution, the aerosol generating apparatus 100 outputs a second solution. In this case, the second solution may be implemented by an expert in the art. Accordingly, a user of the aerosol generating apparatus 100 may resolve an error in the aerosol generating apparatus 100 without needlessly visiting a repair shop or purchasing a new apparatus.

Hereinafter, example operations of the aerosol generating apparatus 100 will be described in detail with reference to FIGS. 5 to 16.

Figure 5:
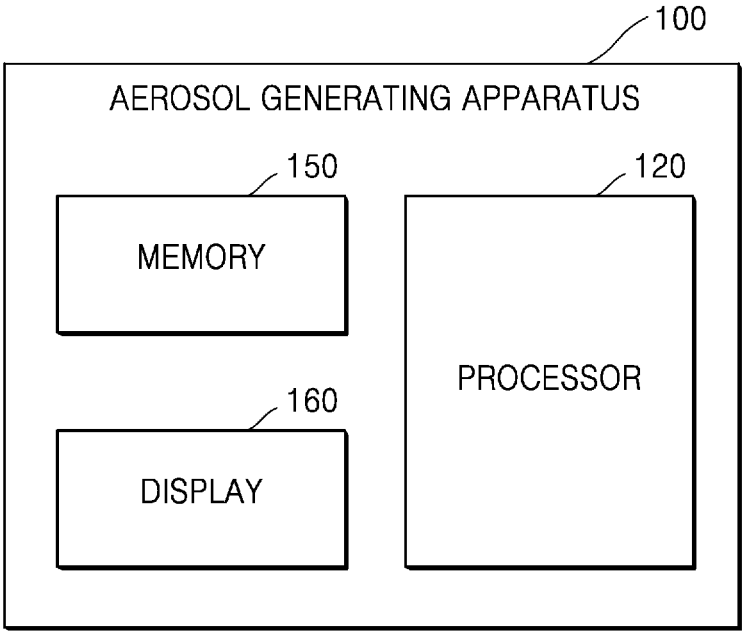
FIG. 5 is a block diagram of an aerosol generating apparatus.

FIG. 5 is a block diagram of the aerosol generating apparatus 100.

The aerosol generating apparatus 100 illustrated in FIG. 5 may correspond to any one of the aerosol generating apparatuses 100 described above with reference to FIGS. 1 to 4. Accordingly, description on the aerosol generating apparatus 100 described above with reference to FIGS. 1 to 4 may also be applied to the aerosol generating apparatus 100 of FIG. 5.

Referring to FIG. 5, the aerosol generating apparatus 100 may include a processor 120, a memory 150, and a display 160.

The memory 150 may store data relating to a state of the aerosol generating apparatus 100. For example, the data may include log data corresponding to events occurred in the aerosol generating apparatus 100. Here, the events may include all operations performed by the aerosol generating apparatus 100 in response to a user input, such as power on/off of the aerosol generating apparatus 100, start of heating, completion of heating, and start of smoking. In addition, the events may include all abnormal operations or errors generated in the aerosol generating apparatus 100. An example of the log data will be described below with reference to FIG. 7.

The display 170 may output information relating to the aerosol generating apparatus 100. Here, the information relating to the aerosol generating apparatus 100 may include all kinds of information relating to operation of the aerosol generating apparatus 100. For example, the display 170 may deliver information about a state of the aerosol generating apparatus 100 (for example, whether or not the aerosol generating apparatus is operable), information about the heater 130 (for example, start of preheating, progress of preheating, completion of preheating, and so on), information about the battery 110 (for example, remaining capacity, availability, and so on of the battery 110), information about reset of the aerosol generating apparatus 100 (for example, reset timing, progress of reset, completion of reset, and so on), information about cleaning of the aerosol generating apparatus 100 (for example, cleaning timing, need of cleaning, progress of cleaning, completion of cleaning, and so on), information about charging of the aerosol generating apparatus 100 (for example, need to charging, progress of charging, completion of charging, and so on), information about puff (for example, the number of puffs, notice of end of puff, and so on), information about safety (for example, elapse of use time, and so on), etc.

In addition, the display 100 may output an error generated in the aerosol generating apparatus 100 and/or a solution to the error. Accordingly, a user can check a method of resolving an error of the aerosol generating apparatus 100 through the display 100. An example of operating the display 100 will be described below with reference to FIGS. 13 and 15.

The processor 120 controls operations of the memory 150 and the display 160. For example, the processor 120 may read data stored in the memory 150 or write data to the memory 150. In addition, the processor 120 may control the display 160 to output predetermined information on the display 160. In addition, the processor 100 may control other components included in the aerosol generating apparatus 100 as described with reference to FIGS. 1 to 4.

In addition, the processor 120 may detect an abnormal operation of the aerosol generating apparatus 100 and perform self-diagnosis on modules included in the aerosol generating apparatus 100. Here, the modules refer to components included in the aerosol generating apparatus 100. That is, the modules include not only the components illustrated in FIGS. 1 to 5, but also other general components included in the aerosol generating apparatus 100.

In addition, the processor 120 controls the display 160 to output a first solution corresponding to an error detected according to self-diagnosis. Then, the processor 120 determines whether or not an error is resolved by the first solution being executed, and when the error is not resolved, the processor 120 controls the display 160 such that a second solution is output.

As described above, the processor 120 may accurately detect an error generated in the aerosol generating apparatus 100 according to self-diagnosis. In addition, the processor 120 may provide sequential solutions according to whether or not an error is resolved, and thus, a user may save time and costs.

Hereinafter, example operations of the processor 120 will be described with reference to FIGS. 6 to 16.

Figure 6:
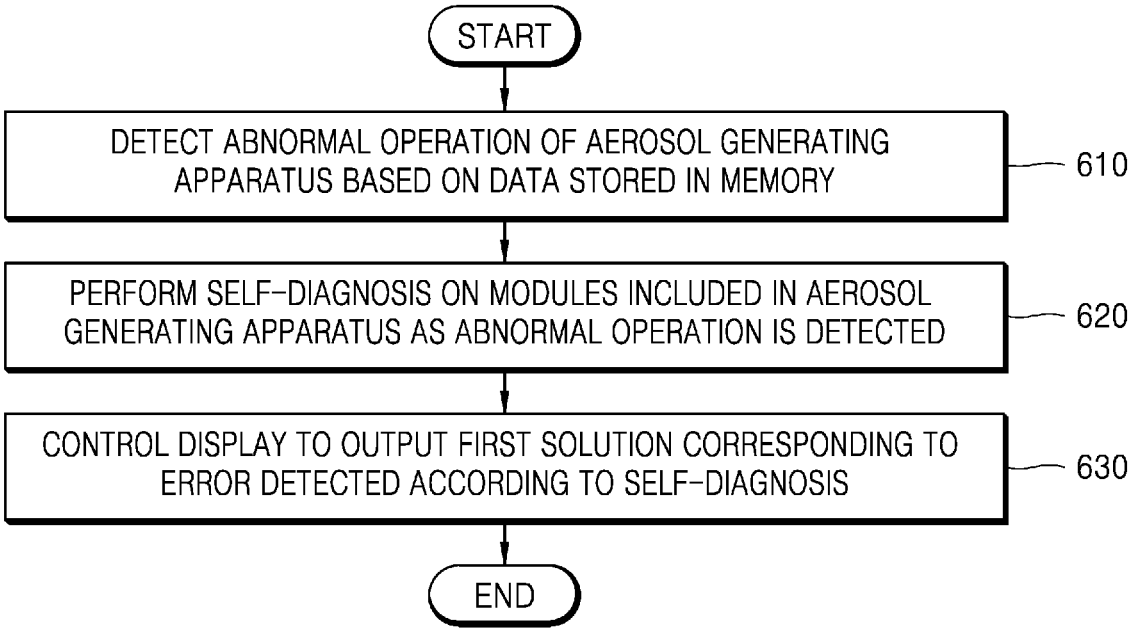
FIG. 6 is a flowchart illustrating an example of a method of controlling an aerosol generating apparatus.

FIG. 6 is a flowchart illustrating an example of a method of controlling an aerosol generating apparatus.

Referring to FIG. 6, a method of controlling an aerosol generating apparatus may include steps processed in a time series by the processor 120 illustrated in FIGS. 1 to 5. Accordingly, it may be seen that, in spite of being omitted below, the content described above with respect to the processor 120 illustrated in FIGS. 1 to 5 is also applied to the method of controlling the aerosol generating apparatus of FIG. 6.

In step 610, the processor 120 may detect an abnormal operation of the aerosol generating apparatus 100 based on data stored in the memory 150.

Here, the abnormal operation may correspond to any cases in which the aerosol generating apparatus 100 does not operate normally. For example, the processor 120 may determine whether or not an abnormal operation is performed in the aerosol generating apparatus 100 by using log data stored in the memory 150. The log data includes information on all events occurred in the aerosol generating apparatus 100. Accordingly, the processor 120 may detect an abnormal operation of the aerosol generating apparatus 100 by checking the log data.

Hereinafter, an example of the log data will be described with reference to FIG. 7.

FIG. 7 is a diagram illustrating an example of log data generated by an aerosol generating apparatus.

The log data 700 may include logs corresponding to events occurred in the aerosol generating apparatus 100. Specifically, log data 700 may include a log (hereinafter, referred to as a "normal log") corresponding to normal operations performed by the aerosol generating apparatus 100 and a log 710 (hereinafter, referred to as an "abnormal log") corresponding to abnormal operations performed by the aerosol generating apparatus 100. The log data 700 may be configured by recording logs in the order of occurrence time of events.

Meanwhile, the abnormal log 710 included in the log data 700 may also be collected and copied in another area of the memory 150. Hereinafter, an example of storing the log data 700 in a divided manner in the memory 150 will be described with reference to FIG. 8.

Figure 8:
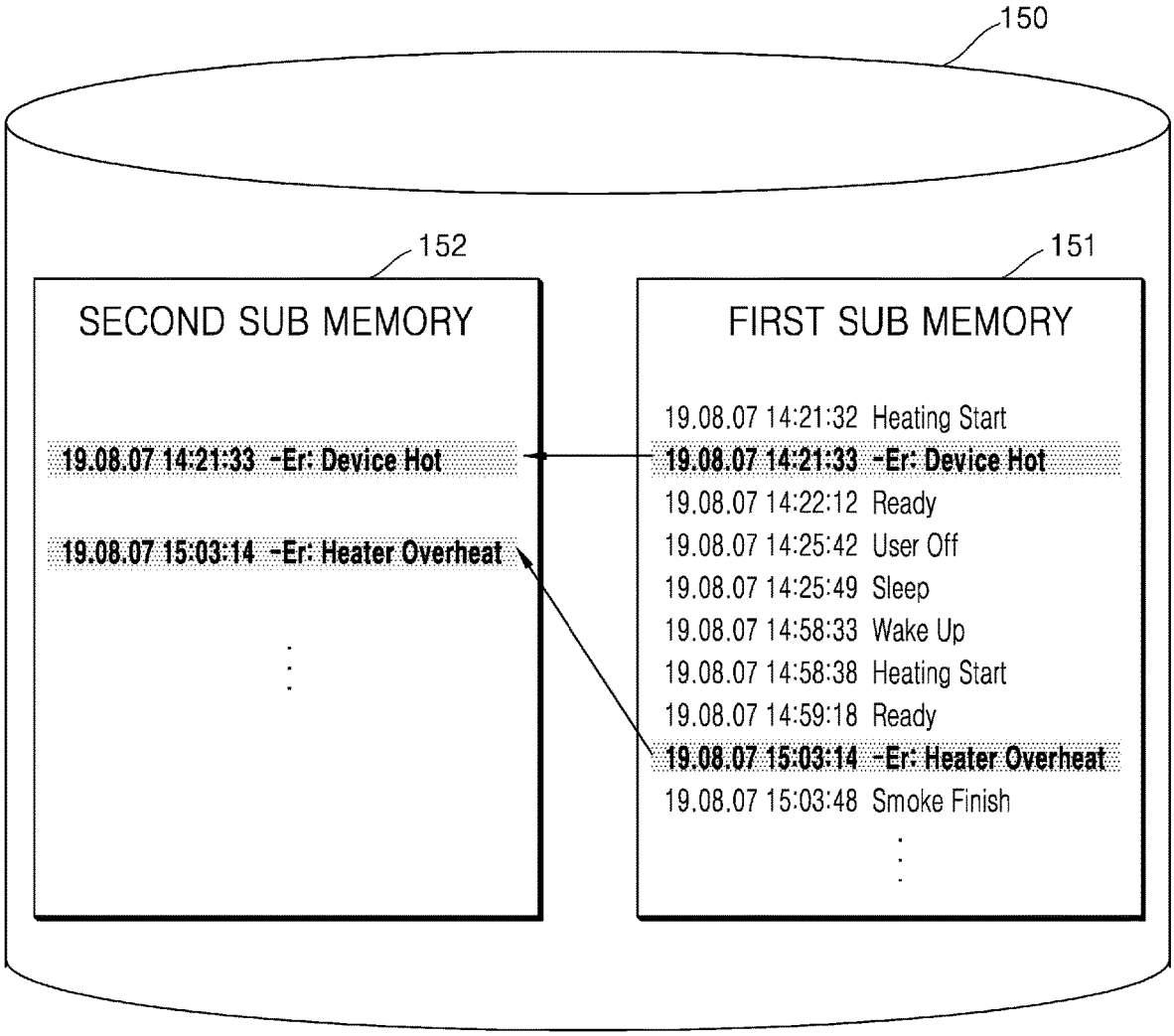
FIG. 8 is a diagram illustrating an example of storing log data in a memory.

FIG. 8 is a diagram illustrating an example of storing log data in a memory.

Referring to FIG. 8, the memory 150 may include a first sub memory 151 and a second sub memory 152. For example, the memory 150 may be a flash memory, but is not limited thereto.

The log data 700 of FIG. 7 may be stored in the first sub memory 151. In other words, normal logs and abnormal logs may be stored in the first sub memory 151 in the order of occurrence. In addition, the processor 120 may extract abnormal logs from log data stored in the first sub memory 151 and write the extracted abnormal logs to the second sub memory 152.

In general, it is difficult for all logs of the aerosol generating apparatus 100 to be stored in the memory 150 due to limitation of a storage capacity of the memory 150. In general, when a size of the log data exceeds a capacity of the memory 150, the logs previously stored in the memory 150 are removed in the order of storage.

In a case where only abnormal logs are stored in the second sub-memory 152, the processor 120 may check the history of abnormal operations over a longer period of time. Accordingly, a developer or a researcher of the aerosol generating apparatus 100 or a technician of a repair shop may effectively monitor an abnormal operation of the aerosol generating apparatus 100.

Referring back to FIG. 6, the processor 120 may detect an abnormal operation of the aerosol generating apparatus 100 based on abnormal logs recorded in the log data. For example, when a single abnormal log is recorded in the log data, the processor 120 may determine that an abnormal operation is performed by the aerosol generating apparatus 100. Alternatively, when abnormal logs are recorded in the log data for a predetermined number of times or more during a predetermined time period, the processor 120 may determine that an abnormal operation is performed by the aerosol generating apparatus 100. As another example, when the abnormal logs are consecutively recorded in the log data, the processor 120 may also determine that an abnormal operation is performed by the aerosol generating apparatus 100.

In step 620, the processor 120 may perform self-diagnosis on modules included in the aerosol generating apparatus 100 as an abnormal operation is detected.

For example, the processor 120 may perform self-diagnosis on modules included in the aerosol generating apparatus 100 in a predetermined order. Here, the predetermined order may be determined according to the frequency of occurrence of abnormal operations in the modules. An example of performing the order in which self-diagnosis is performed will be described below with reference to FIG. 9.

When an abnormal operation is not detected as a result of self-diagnosis on a module having a priority, the processor 120 may perform self-diagnosis on a module having the next priority. That is, when an abnormal operation is not detected as a result of self-diagnosis on the $N^{th}$ module, the processor 120 may perform self-diagnosis on the $N+1_{th}$ module. Here, N indicates the order in which self-diagnosis has to be performed and is a natural number of 1 or more. An example in which the processor 120 performs self-diagnosis according to a predetermined order will be described below with reference to FIG. 10.

Figure 9:
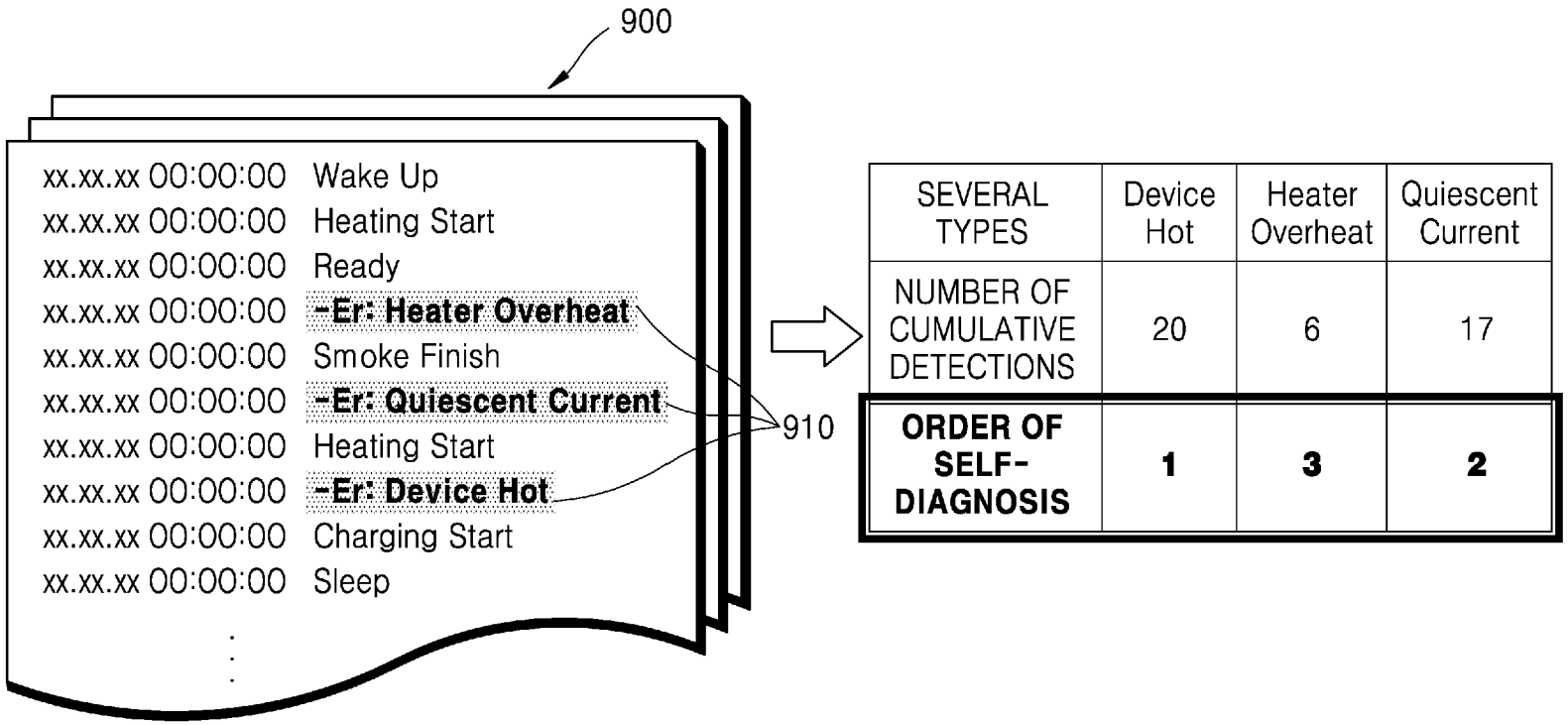
FIG. 9 is a diagram illustrating an example of determining an order in which self-diagnosis is performed.

FIG. 9 is a diagram illustrating an example of determining an order in which self-diagnosis is performed.

FIG. 9 illustrates an example of log data 900 stored in the memory 150. The log data 900 includes both normal logs and abnormal logs.

The log data 900 includes information on all events occurred in the aerosol generating apparatus 100. Accordingly, the processor 120 may check an operation history of the aerosol generating apparatus 100 by checking the log data 900. For example, if events occurred during the last month are recorded in the log data 900, the processor 120 may check abnormal operations performed during the last month by checking the log data 900.

The processor 120 may detect the abnormal logs 910 from the log data 900 and accumulate the detected abnormal logs for each type. According to the example illustrated in FIG. 9, the processor 120 may check that 20 abnormal logs of "Device Hot" are included in the log data 900, six abnormal logs of "Heater Overheat" are included in the log data 900, and 17 abnormal logs of "Quiescent Current" are included in the log data 900.

The processor 120 may determine an order of self-diagnosis according to the number of abnormal logs accumulated for each type. According to the example illustrated in FIG. 9, the processor 120 may detect that abnormal operations have been performed by the aerosol generating apparatus 100 in the order of "Device Hot", "Quiescent Current", and "Heater Overheat". Accordingly, the processor 120 may perform self-diagnosis in the order of modules relating to the abnormal operation corresponding to "Device Hot", modules relating to the abnormal operation corresponding to "Quiescent Current", and modules relating to the abnormal operation corresponding to "Heater Overheat".

Figure 10:
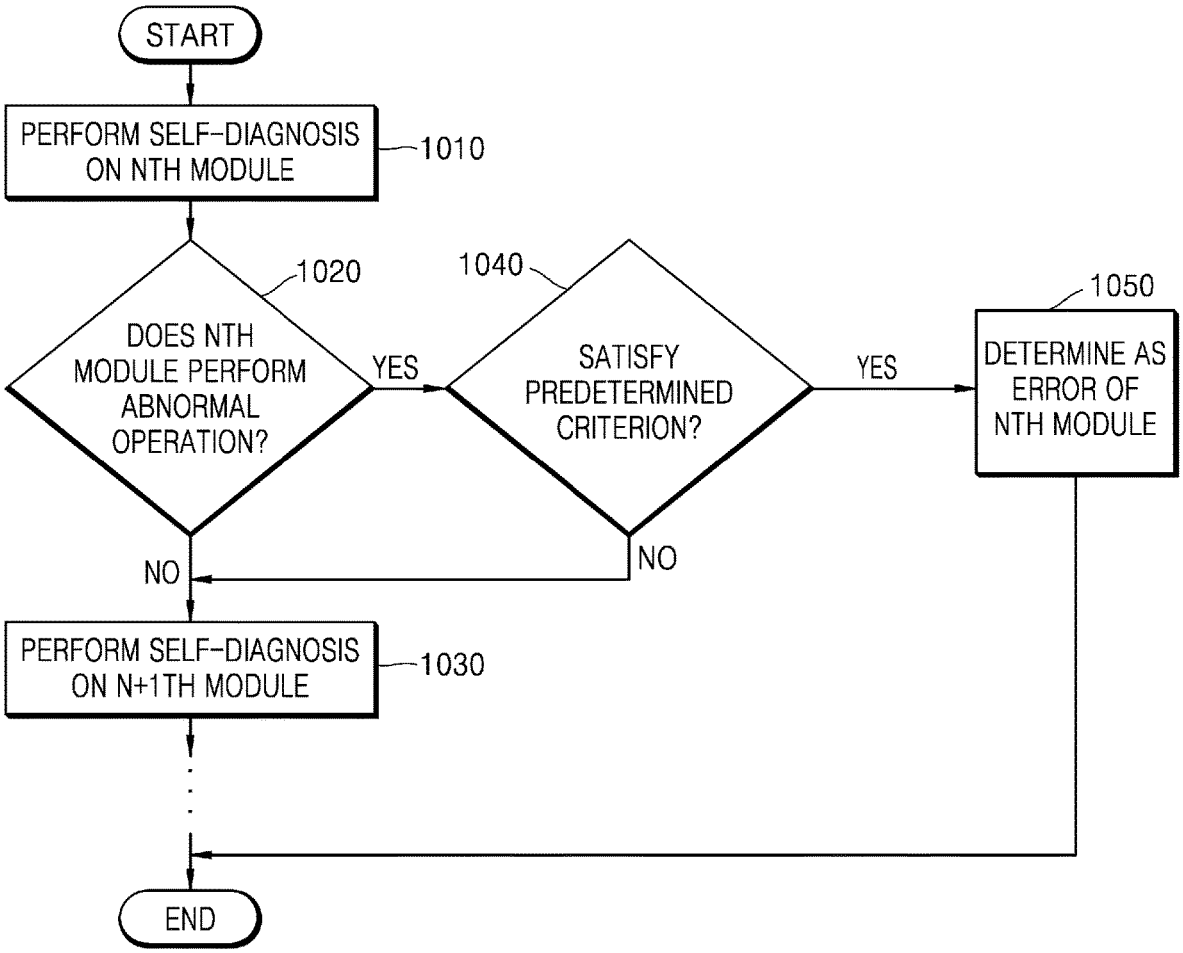
FIG. 10 is a flowchart illustrating an example in which a processor performs self-diagnosis on a module.

FIG. 10 is a flowchart illustrating an example in which a processor performs self-diagnosis on modules.

In step 1010, the processor 120 performs self-diagnosis on the $N^{th}$ module. For example, assuming that many abnormal operations have been performed by a heating integrated circuit (IC) according to an operation history of the aerosol generating apparatus 100, the processor 120 may first perform self-diagnosis on the heating IC.

In step 1020, the processor 120 determines whether or not an abnormal operation is performed by the $N^{th}$ module. For example, the processor 120 may transmit a command relating to an operation of a heating IC and determine whether or not the heating IC operates normally by reading a register of the heating IC. However, the operation of the processor 120 described above is only an example, and is not limited thereto. Therefore, the processor 120 may determine whether or not the heating IC performs an abnormal operation in various different ways.

When the $N^{th}$ module operates normally, the processing proceeds to step 1030, and when the $N^{th}$ module does not operate normally, the processing proceeds to step 1040.

In step 1040, the processor 120 compares the result of self-diagnosis with a predetermined criterion. For example, the predetermined criterion may be determined according to the number of cumulative detections or the number of consecutive detections during a predetermined time period.

For example, when the processor 120 determines that an abnormal operation is performed by the heating IC, the processor 120 may check how many times the abnormal operation of the heating IC is repeated for a predetermined time period (for example, 1 hour). Alternatively, the processor 120 may check how many times the abnormal operation of the heating IC is consecutively performed.

As an example, the processor 120 may check the number of repetitions of the abnormal operation or the number of consecutive abnormal operations by the process described above with reference to step 1020 (that is, by directly inspecting a module). As another example, the processor 120 may also check log data to check the number of repetitions of the abnormal operation or the number of consecutive abnormal operations. In addition, the processor 120 may determine whether or not the number of repetitions of the abnormal operation or the number of consecutive abnormal operations is equal to or greater than a predetermined number (for example, three times).

If the processor 120 determines that the number of repetitions of the abnormal operation or the number of consecutive abnormal operations satisfies a predetermined criterion (i.e., if it is greater than or equal to the predetermined number), the method proceeds to step 1050. On the other hand, if the processor 120 determines that the number of repetitions of the abnormal operation or the number of consecutive abnormal operations does not satisfy a predetermined criterion (i.e., if it is less than the predetermined number), the method proceeds to step 1030.

In step 1050, the processor 120 determines that an error has occurred in the $N^{th}$ module.

Hereinafter, examples of steps 1040 and 1050 will be described in detail with reference to FIGS. 11 and 12.

Figure 11:
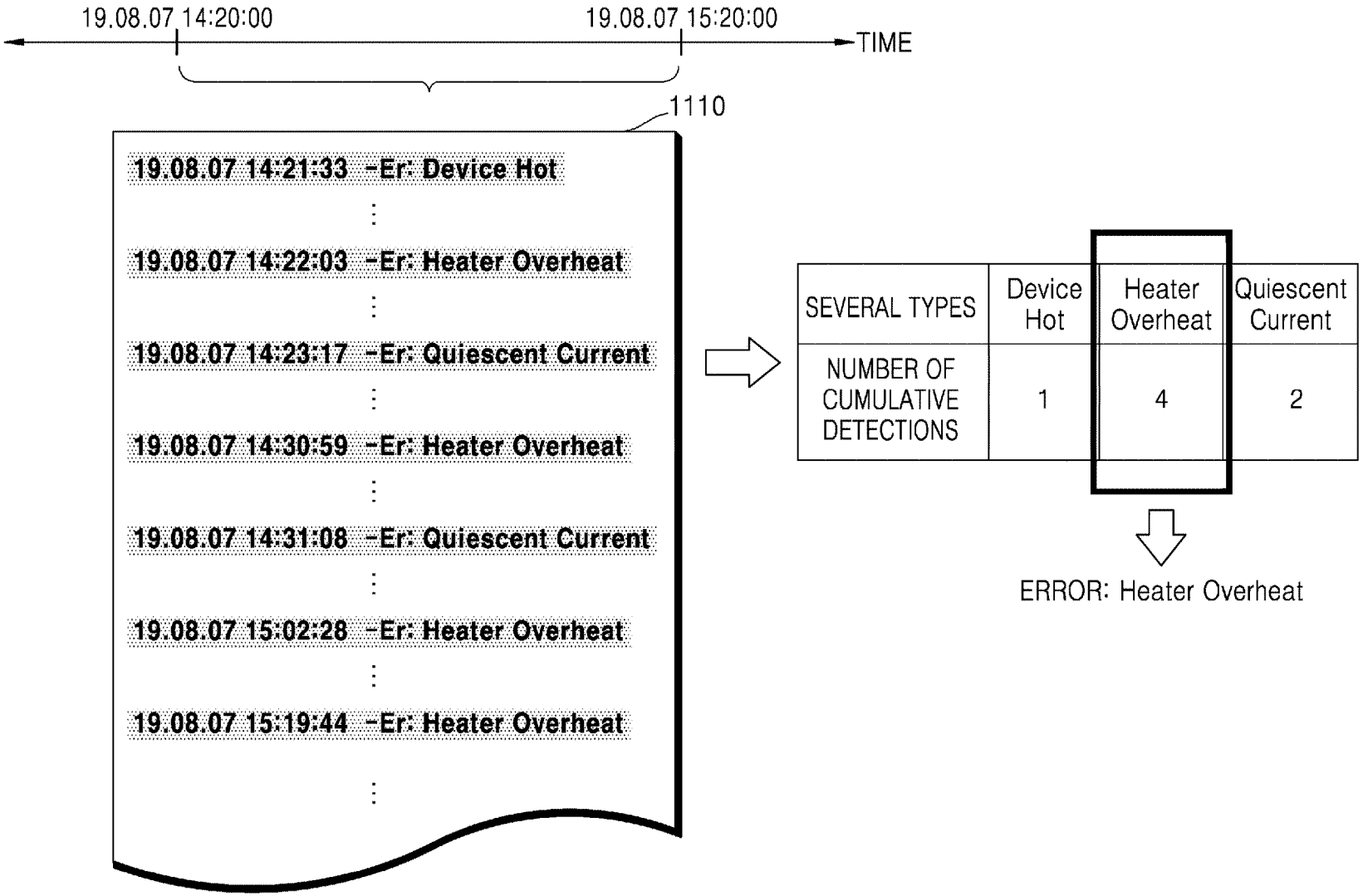
FIG. 11 is a diagram illustrating an example in which a processor compares a result of self-diagnosis with a predetermined criterion.

FIG. 11 is a diagram illustrating an example in which a processor compares a result of self-diagnosis with a predetermined criterion.

FIG. 11 illustrates an example in which the processor 120 may check the number of repetitions of an abnormal operation by using log data 1110. However, in another example, the processor 120 may also check the number of repetitions of the abnormal operation by directly inspecting a module, as described above with reference to step 1020 of FIG. 10.

In FIG. 11, it is assumed that an abnormal operation has been performed by a module relating to "Heater Overheat" of log data 1110, according to steps 1010 and 1020 of FIG. 10.

The processor 120 may check abnormal logs of a predetermined time period in the log data 1110. For example, a predetermined time period may be 1 hour as shown in FIG. 11, but is not limited thereto.

In addition, the processor 120 accumulates abnormal logs of each type. According to the example illustrated in FIG. 11, the processor 120 may detect one abnormal log of "Device Hot", four abnormal logs of "Heater Overheat" and two abnormal logs of "Quiescent Current".

In addition, the processor 120 determines whether or not the number of cumulative detections of an abnormal log (that is, the number of repetitions of the abnormal operation) satisfies a predetermined criterion. For example, if the detected number of repetitions of an abnormal operation is 3 or more, the processor 120 determines that an error has occurred in an operation of a module relating to "Heater Overheat".

Figure 12:
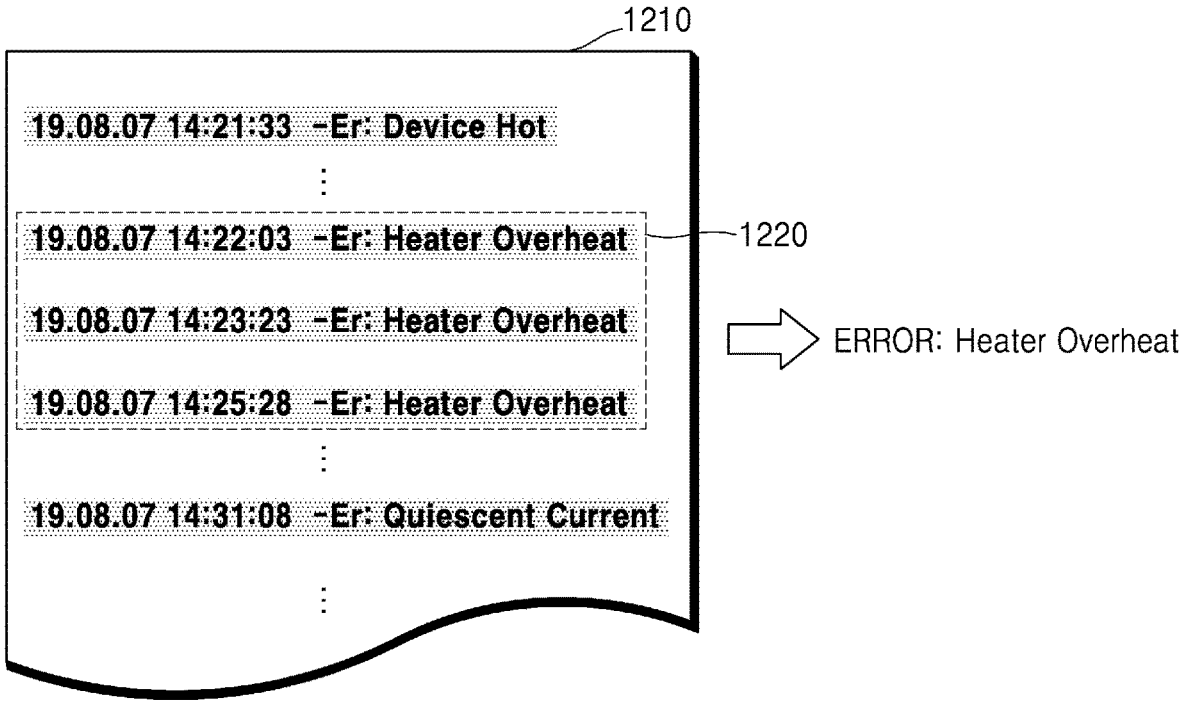
FIG. 12 is a diagram illustrating another example in which a processor compares a result of self-diagnosis with a predetermined criterion.

FIG. 12 is a diagram illustrating another example in which the processor compares a result of self-diagnosis with a predetermined criterion.

FIG. 12 illustrates an example in which the processor 120 may check the number of consecutive abnormal operations by using log data 1210. However, the processor 120 may also check the number of consecutive abnormal operations in the manner described above with reference to step 1020 of FIG. 10.

In FIG. 12, it is assumed that an abnormal operation has been performed by a module relating to "Heater Overheat" of log data 1210, according to steps 1010 and 1020 of FIG. 10.

The processor 120 may check abnormal logs in the log data 1210. For example, the processor 120 may check abnormal logs in the log data 1210 after step 1010 of FIG. 10 is performed.

In addition, the processor 120 may check the consecutive abnormal logs 1220 and determine whether or not the number of consecutive abnormal logs 1220 (that is, the number of consecutive abnormal operations) satisfies a predetermined criterion. According to the example illustrated in FIG. 12, the processor 120 detects that an abnormal log of "Heater Overheat" is consecutively recorded three times in the log data 1210. In this case, assuming that the predetermined criterion is three times or more of consecutive abnormal operations, the processor 120 may determine that an error has occurred in an operation of a module relating to "Heater Overheat".

Referring back to FIG. 10, in step 1030, the processor 120 may perform self-diagnosis on the $N+1^{th}$ module. In addition, the processor 120 may determine whether or not an error has occurred in the $N+1^{th}$ module. This is the same as the process described above with reference to steps 1020 to 1050. Referring to the example of step 1020, if an abnormal operation by a heating IC is not detected, the processor 120 may check whether or not the battery 110 or the processor 120 is overheated. For example, the processor 120 may check whether or not the battery 110 or the processor 120 is overheated through a thermistor connected to the battery 110 or a thermistor connected to the processor 120. However, the operation of the processor 120 described above is only an example of determining whether or not the battery 110 or the processor 120 is overheated, and whether or not the battery 110 or the processor 120 is overheated may be determined in various ways.

If the $N+1^{th}$ module operates normally, the processor 120 may perform self-diagnosis on the $N+2^{th}$ module and determine whether or not an error has occurred in the $N+2^{th}$ module. This is the same as the process described above with reference to steps 1020 through 1050.

In this way, the processor 120 may sequentially perform self-diagnosis on modules included in the aerosol generating apparatus 100.

In addition, the self-diagnosis on a heating IC and the self-diagnosis on the battery 110 or the processor 120 described above with reference to FIG. 10 are only examples taken for convenient description. That is, priority of modules for self-diagnosis and a self-diagnosis method may be determined in various ways.

Referring back to FIG. 6, in step 630, the processor 120 controls the display 160 to output a first solution corresponding to an error detected according to self-diagnosis.

Here, the first solution may be a method performed by a user of the aerosol generating apparatus 100. In other words, the processor 120 may provide a user with a solution that may be performed by a user other than an expert relating to the aerosol generating apparatus 100 (for example, a technician of a repair shop). Hereinafter, examples in which the first solution is output to the display 160 will be described with reference to FIG. 13.

Figure 13:
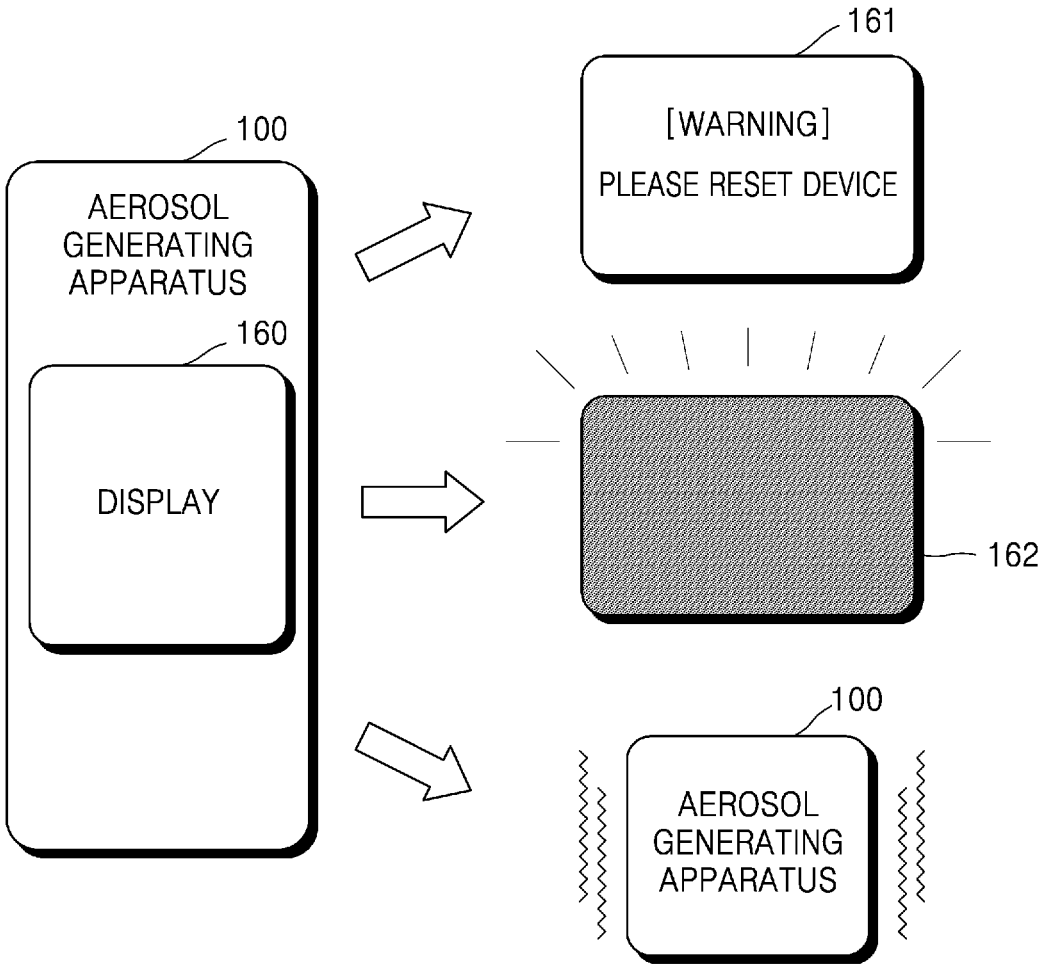
FIG. 13 is a diagram illustrating examples of outputting a first solution on a display.

FIG. 13 is a diagram illustrating examples in which a first solution is output to a display.

Referring to FIG. 13, a message 161 describing a first solution may be displayed on the display 160. Alternatively, a specific color 162 corresponding to the first solution may be displayed on the display 160.

Alternatively, although not illustrated in FIG. 13, the display 160 may flicker according to a predetermined pattern representing the first solution.

When the aerosol generating apparatus 100 includes a motor, the processor 120 may control the motor to output a vibration representing the first solution.

Meanwhile, the processor 120 may further output a second solution which is different from the first solution. Hereinafter, an example in which the processor 120 outputs a second solution will be described with reference to FIGS. 14 and 15.

Figure 14:
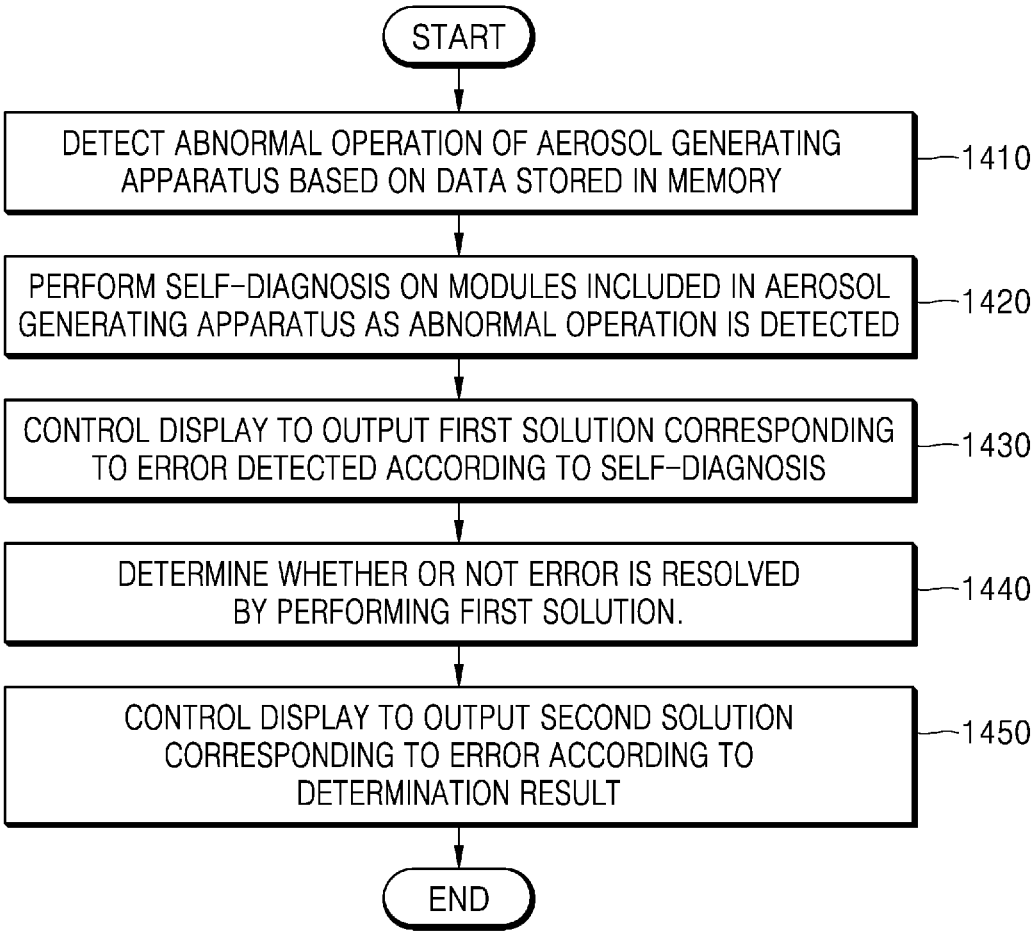
FIG. 14 is a flowchart illustrating another example of a method of controlling an aerosol generating apparatus.

FIG. 14 is a flowchart illustrating another example of a method of controlling an aerosol generating apparatus.

Referring to FIG. 14, a method of controlling an aerosol generating apparatus may include steps processed in a time series by the processor 120 illustrated in FIGS. 1 to 5. Accordingly, it may be seen that, in spite of being omitted below, the content described above with respect to the processor 120 illustrated in FIGS. 1 to 5 is also applied to the method of controlling the aerosol generating apparatus of FIG. 14.

In addition, steps 1410 to 1430 of FIG. 14 correspond to steps 610 to 630 of FIG. 6. Accordingly, detailed description on steps 1410 to 1430 will be omitted below.

In step 1440, the processor 120 determine whether or not an error is resolved by performing the first solution.

For example, the processor 120 may determine whether or not an error is resolved by checking log data after the first solution is performed. When a log corresponding to an error is not found in the log data after the first solution is performed, the processor 120 may determine that the error is resolved.

In step 1450, the processor 120 may control the display 160 to output a second solution corresponding to an error according to a determination result in step 1440.

When a log corresponding to an error is still found in the log data after the first solution is performed, the processor 120 may control the display 160 to output the second solution.

Here, the second solution indicate a method different from the first solution. For example, the second solution may recommend visiting an expert (for example, a technician of a repair shop) on the aerosol generating apparatus 100.

The fact that the error is not resolved even by the first solution indicates that a user may not be able to repair the aerosol generating apparatus 100. Accordingly, the processor 120 may recommend a user to visit an expert on the aerosol generating apparatus 100 so that the aerosol generating apparatus 100 is professionally repaired.

Hereinafter, examples of outputting the second solution to the display 160 will be described with reference to FIG. 15.

Figure 15:
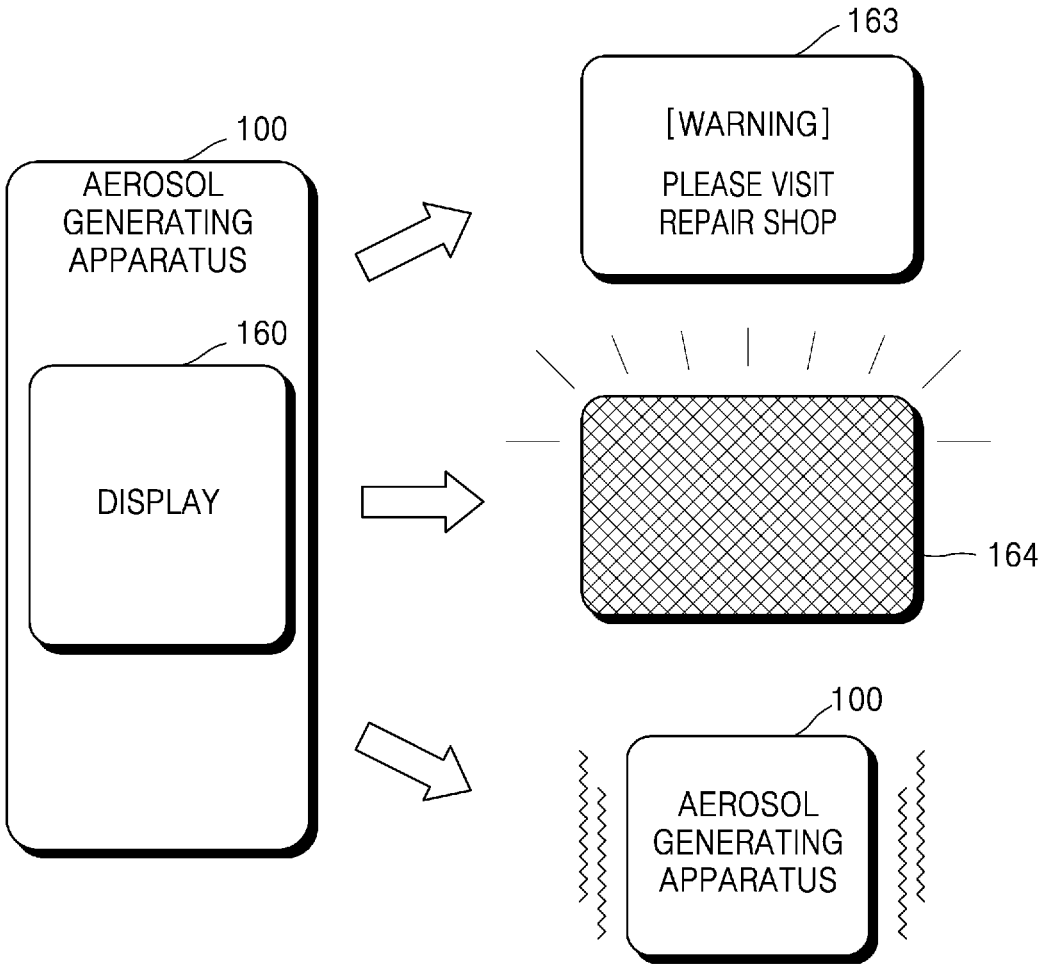
FIG. 15 is a diagram illustrating examples of outputting a second solution on a display.

FIG. 15 is a diagram illustrating examples of outputting a second solution to a display.

Referring to FIG. 15, a message 163 describing the second solution may be displayed on the display 160. Alternatively, a specific color 164 corresponding to the second solution may also be displayed on the display 160. Alternatively, although not illustrated in FIG. 15, the display 160 may flicker according to a predetermined pattern representing the second solution. When the aerosol generating apparatus 100 includes a motor, the processor 120 may control the motor to output a vibration representing the second solution.

As described above with reference to FIG. 14, the first solution and the second solution are methods different from each other. Accordingly, the message 163, the specific color 164, the flickering pattern, and the vibration described above with reference to FIG. 15 are different from those of FIG. 13.

As described above with reference to FIGS. 14 and 15, the processor 120 may provide a second solution to a user when an error is not resolved by the first solution. However, in an embodiment, the processor 120 may also provide the second solution to a user regardless of whether or not an error according to the first solution is resolved.

Figure 16:
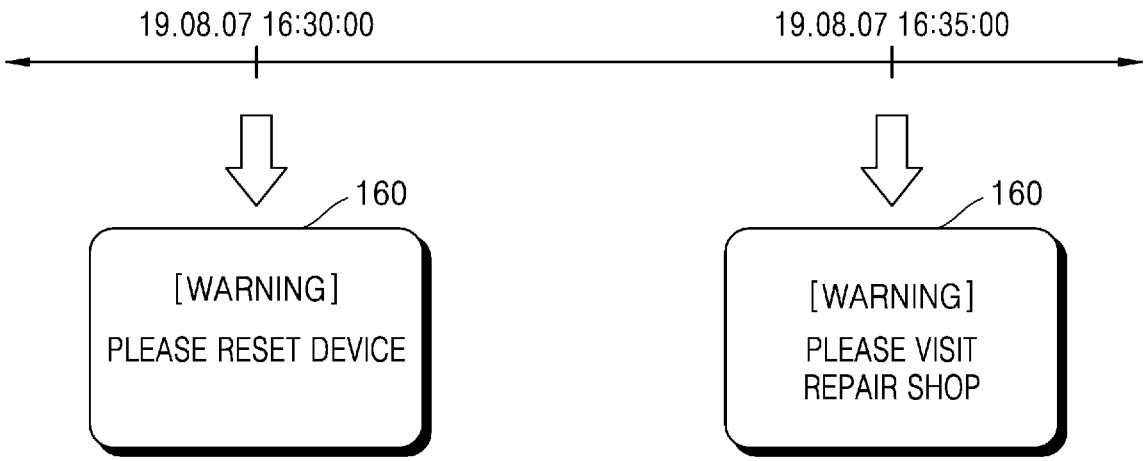
FIG. 16 is a diagram illustrating an example in which a processor outputs a first solution and a second solution.

FIG. 16 is a diagram illustrating an example in which a processor outputs a first solution and a second solution.

The processor 120 may control the display 160 so that the first solution and the second solution are output at different points in time. For example, the processor 120 may provide the first solution through the display 160. In addition, the processor 120 may provide the second solution through the display 160 after a certain time period elapses from a point in time when the first solution is provided.

In this case, the processor 120 may also not determine whether or not an error is resolved by the first solution. That is, the processor 120 may provide an opportunity for a user to select a specific solution by outputting various methods for resolving an error.

As described above, according to the embodiments, the processor 120 may accurately detect an error generated in the aerosol generating apparatus 100 according to self-diagnosis. In addition, the processor 120 may provide multiple solutions sequentially based on whether or not the error is resolved, and thus, a user may save time and cost.

At least one of the components, elements, modules or units (collectively "components" in this paragraph) represented by a block in the drawings may be embodied as various numbers of hardware, software and/or firmware structures that execute respective functions described above, according to an exemplary embodiment. For example, at least one of these components may use a direct circuit structure, such as a memory, a processor, a logic circuit, a look-up table, etc. that may execute the respective functions through controls of one or more microprocessors or other control apparatuses. Also, at least one of these components may be specifically embodied by a module, a program, or a part of code, which contains one or more executable instructions for performing specified logic functions, and executed by one or more microprocessors or other control apparatuses. Further, at least one of these components may include or may be implemented by a processor such as a central processing unit (CPU) that performs the respective functions, a microprocessor, or the like. Two or more of these components may be combined into one single component which performs all operations or functions of the combined two or more components. Also, at least part of functions of at least one of these components may be performed by another of these components. Further, although a bus is not illustrated in the above block diagrams, communication between the components may be performed through the bus. Functional aspects of the above exemplary embodiments may be implemented in algorithms that execute on one or more processors. Furthermore, the components represented by a block or processing steps may employ any number of related art techniques for electronics configuration, signal processing and/or control, data processing and the like.

Meanwhile, the above-described method may be written as a program that may be executed by a computer, and may be implemented by a general-purpose digital computer that executes the program by using a computer-readable recording medium. In addition, a structure of data used in the above-described method may be recorded on a computer-readable recording medium through various means. The computer-readable recording medium includes storage media such as magnetic storage media (for example, ROM, RAM, USB, floppy disk, hard disk, and so on) and optical reading media (for example, CD-ROM, DVD, and so on).

Those skilled in the technical field relating to the present embodiment will appreciate that the present disclosure may be implemented in a modified form without departing from the essential characteristics of the above description. Therefore, the disclosed methods should be considered from an explanatory point of view rather than a limiting point of view, and the scope of rights is shown in the claims rather than the above description, and should be interpreted as including all differences within the scope equivalent thereto.

The invention claimed is:

1. An aerosol generating apparatus comprising:

a memory configured to store data relating to a state of the aerosol generating apparatus;

a display; and a processor configured to:

detect an abnormal operation of the aerosol generating apparatus based on the data stored in the memory, perform self-diagnosis on modules included in the aerosol generating apparatus based on the abnormal operation being detected, and control the display to output a first solution corresponding to an error detected according to the self-diagnosis, wherein the processor is configured determine whether or not the error is resolved after the first solution is output, and control the display to output a second solution corresponding to the error based on a result of the determination, and wherein the second solution is different from the first solution.

2. The aerosol generating apparatus of claim 1, wherein the first solution is a method to be performed by a user of the aerosol generating apparatus.

3. The aerosol generating apparatus of claim 1, wherein the processor is configured to detect the error by comparing a result of the self-diagnosis with a predetermined criterion.

4. The aerosol generating apparatus of claim 3, wherein the predetermined criterion is based on a number of cumulative detections of the abnormal operation or a number of consecutive detections of the abnormal operation during a predetermined time period.

5. The aerosol generating apparatus of claim 1, wherein the data relating to the state of the aerosol generating apparatus includes information about events that occurred in the aerosol generating apparatus.

6. The aerosol generating apparatus of claim 1, wherein the processor is configured to control the display to output the second solution different from the first solution at different points of time.

7. The aerosol generating apparatus of claim 4, wherein the predetermined criterion is based on the number of the cumulative detections of the abnormal operation during the predetermined time period, and wherein the processor is configured to detect the error based on the number of the cumulative detections of the abnormal operation being equal to or greater than a predetermined number.

8. The aerosol generating apparatus of claim 4, wherein the predetermined criterion is based on the number of the consecutive detections of the abnormal operation during the predetermined time period, and wherein the processor is configured to detect the error based on the number of the consecutive detections of the abnormal operation being equal to or greater than a predetermined number.

9. An aerosol generating apparatus comprising:

a memory configured to store data relating to a state of the aerosol generating apparatus;

a display; and a processor configured to:

detect an abnormal operation of the aerosol generating apparatus based on the data stored in the memory, perform self-diagnosis on modules included in the aerosol generating apparatus based on the abnormal operation being detected, and control the display to output a first solution corresponding to an error detected according to the self-diagnosis, wherein the processor is further configured to perform the self-diagnosis on the modules according to a predetermined order, and wherein the processor is further configured to determine the predetermined order according to a frequency of occurrence of the abnormal operation in the modules.

10. The aerosol generating apparatus of claim 9, wherein the processor is configured to perform the self-diagnosis on an $N^{th}$ module among the modules according to the predetermined order, based on an abnormal operation of the $N^{th}$ module not being detected, perform the self-diagnosis on an $N+1^{th}$ module among the modules, and N is a natural number.

11. A method of controlling an aerosol generating apparatus, the method comprising:

detecting an abnormal operation of the aerosol generating apparatus based on data stored in a memory;

performing self-diagnosis on modules included in the aerosol generating apparatus based on the abnormal operation being detected;

controlling a display to output a first solution corresponding to an error detected according to the self-diagnosis;

determining that the error is not resolved after the first solution is output; and control the display to output a second solution corresponding to the error based determining that the error is not resolved after the first solution is output, wherein the second solution is different from the first solution.

12. A computer-readable recording medium on which is recorded a program capable of performing the method of claim 11 on a computer.

* * * * *